United States Patent [19]

Pratt et al.

[11] 4,262,714

[45] Apr. 21, 1981

[54] LOG SPLITTING ATTACHMENT FOR TRACTOR THREE POINT HITCH MEMBERS

[75] Inventors: George F. Pratt; Richard Ziehnert, both of Elk, Wash.

[73] Assignee: James L. Price, Spokane, Wash.

[21] Appl. No.: 49,625

[22] Filed: Jun. 18, 1979

[51] Int. Cl.[3] ..... B27L 7/00

[52] U.S. Cl. ..... 144/193 A

[58] Field of Search ..... 144/193 A, 193 R

[56] References Cited

U.S. PATENT DOCUMENTS

| | | | |
|---|---|---|---|
| 3,285,304 | 11/1966 | Fuller | 144/193 A |
| 3,319,675 | 5/1967 | Bles, Sr. | 144/193 A |
| 3,780,779 | 12/1973 | Guy | 144/193 A |
| 3,938,567 | 2/1976 | Dircksen et al. | 144/193 A |
| 4,111,246 | 9/1978 | La Pointe | 144/193 R |
| 4,112,985 | 9/1978 | Gosselin | 144/193 A |
| 4,199,015 | 4/1980 | Doering | 144/193 A |

FOREIGN PATENT DOCUMENTS

| | | | |
|---|---|---|---|
| 2711689 | 9/1978 | Fed. Rep. of Germany | 144/193 A |

*Primary Examiner*—Willie G. Abercrombie

*Attorney, Agent, or Firm*—James L. Price

[57] ABSTRACT

An attachment is described that is mountable to the rearward three point hitch members of a tractor and is operable in response to relative movement of the three point hitch members to split logs. The device includes a top hitch connector member that is releasably mountable to the single tractor top hitch member. A cross connector member is adapted to mount between the two tractor bottom hitch members. A splitting blade is mounted on one of the connector members and a log support surface is located on the remaining member. A guide mechanism is also provided for movably joining the two connector members for guiding relative movement of the wood support surface in a line toward and away from the cutting blade. Actuation of a conventional rocker shaft on the tractor to cause upward movement of the bottom hitch member will cause corresponding movement of the cross member toward the top connector member, thereby causing the wood support and the blade to move toward one another. Wood held on the support surface is brought against the blade and is split as the support and blade move toward one another.

12 Claims, 5 Drawing Figures

LOG SPLITTING ATTACHMENT FOR TRACTOR THREE POINT HITCH MEMBERS

BACKGROUND OF THE INVENTION

The present invention is related to wood-splitting mechanisms and more particularly to such mechanisms that are mountable to the three point hitch members of typical wheel tractors.

Manual splitting of logs for firewood is a slow and very strenuous process. It has therefore become desirable to provide mechanical apparatus that will increase the speed and decrease the effort required to split logs into stove or fireplace size chunks of wood. Nearly all such mechanical arrangements include a frame, a movable wood support, a cutting edge in alignment with the support, and some form of powered apparatus for driving either the cutting edge toward the support or the support toward the cutting edge. The powered splitting mechanisms are typically large and cumbersome, some requiring separate suspension and wheel support. Although a mechanized splitting apparatus may be entirely effective for quickly and easily splitting wood, it is usually bulky and extremely expensive, both to purchase and to maintain. This is due primarily to the necessary integral power drive units incorporated within them.

The typical wheel tractor utilized on small estates and farms includes a rearward three point hitch arrangement, including a central upper hitch member and two lower pivoted members. The lower pivoted hitch members can be selectively moved about a common pivot axis by a "rockshaft" for the purpose of lifting or lowering attached implements. The upper central hitch member is stationary on the tractor frame. The lifting mechanism is usually a hydraulic cylinder connected to the rockshaft through a bell crank arrangement. Considerable upward force may be applied through the lift mechanism.

The conventional wheel tractor is often available for use in wood gathering and splitting operations. It therefore becomes desirable to obtain some form of simplified wood splitting apparatus that may be powered by the standard tractor three point hitch arrangement.

U.S. Pat. No. 3,319,675 to M. J. Bles, Sr. discloses a tractor carried log splitter, making use of the three point hitch arrangement for supporting a self powered log splitting arrangement. A hydraulic cylinder is supplied within the splitter frame and is operated by control mechanisms also on the frame for moving a splitting wedge toward and away from a log brace.

U.S. Pat. No. 3,938,567 to Arnold D. Dircksen et al discloses a tractor mounted log splitter including a framework mountable to a three point hitch mechanism of a tractor. This device also includes an integral cylinder arrangement for attachment to the tractor hydraulic system and operates to move a log into engagement with a splitting wedge. The three point hitch frame mechanism is provided merely to enable elevational adjustment of the entire splitting mechanism.

U.S. Pat. No. 4,112,985 granted to Yvon Gosselin discloses a hydraulic log splitter implement. Again, the splitter arrangement is mounted to the three point hitch mechanism of a tractor but includes a separate hydraulic cylinder arrangement for connection to the tractor hydraulics that pivots a wedge arrangement for splitting logs. The device is upright and includes height adjustment features that allow for adjustment to accommodate logs of various sizes. Again, the three point hitch arrangement is used primarily for the purpose of mounting the splitter to the tractor and for raising or lowering the entire splitter unit relative to the ground surface.

An alternate form of log splitting arrangement is illustrated by Guy in U.S. Pat. No. 3,780,779. Guy uses a frame arrangement that replaces a forkarm along the front of a front end loader. The device makes use of a loader operating cylinder for forcing a log against a splitting wedge. The device is mounted at a single pivot point at a forward end of a tractor and, by necessity, includes specific mounting arrangements adapted to position the loader cylinder in relation to the facing edge of the splitting wedge.

LaPointe, in U.S. Pat. No. 4,111,246 illustrates a variation of the Guy arrangement in providing an attachment for backhoe power equipment. Here, a bracket positions the backhoe bucket operating cylinder in relation to the outer boom arm end. An elaborate wood supportive framework is mounted to the outer boom arm end in an upright orientation with the arm and with a wood support surface situated directly below the piston for the cylinder. The piston can therefore be extended to move a log against a splitting wedge.

The front end loader and backhoe arm mounted splitting arrangements may be serviceable. However, the backhoe or bucket loader are not typically provided on the type of tractors that are frequently used for wood cutting and hauling purposes. In fact, if such attachments are provided, it is more convenient to dismount them from the tractor to allow increased maneuverability in wooded areas and to present better visibility for such maneuvering. In order to arrange the devices for operation, the front end loader or backhoe arrangement must first be mounted to the tractor. Then the bucket arrangement must be dismantled and the splitting arrangement remounted to the forwardly extending arms.

The problem remains, therefore, of obtaining some form of splitting apparatus that is easily mounted to and removable from the three point hitch arrangement of wheel tractors and that can rely entirely upon the three hitch hoisting provisions for operation.

DETAILED DESCRIPTION OF A PREFERRED EMDODIMENT

Figure 2:
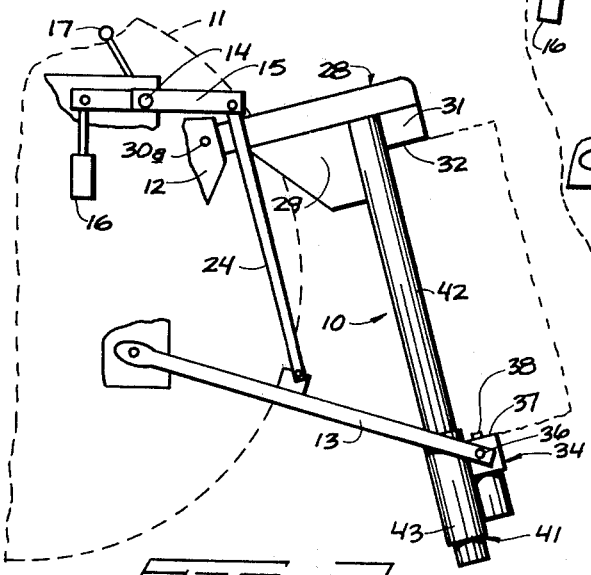
FIG. 2 is a side elevation view of the splitting mechanism and also showing the three point hitch arrangement of a tractor in diagrammatic form, the splitting mechanism being shown in an open position.
Figure 3:
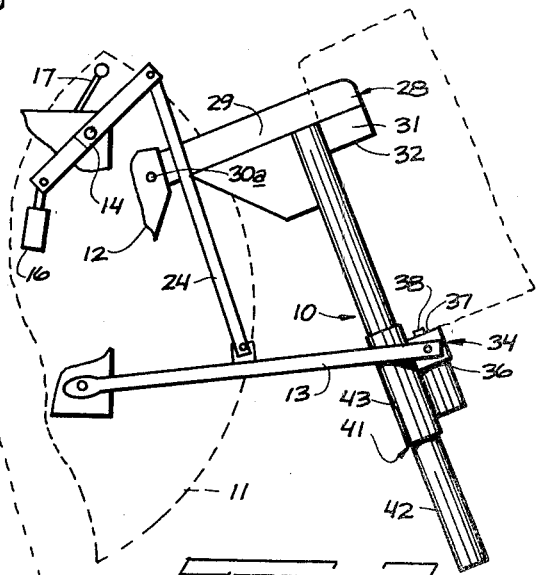
FIG. 3 is a view similar to FIG. 2 only showing the splitter mechanism as it moves toward a closed condition.

The present wood splitting attachment is generally designated in the drawings by the reference character 10. The attachment is mountable to a tractor (diagrammatically) illustrated at 11) by mounting to the three point hitch members thereof. A top hitch member is diagrammatically illustrated at 12 and a bottom hitch member at 13. Actually there are two parallel bottom hitch members spaced horizontally at equal distances from the top hitch member 12. The opposite hitch member 13 is not visible in the drawings. It should be understood, however, that the two bottom hitch members 13 are substantially identical and are operatively connected to a pair of rockshaft arms 15 by a pair of lift links 24. The rockshaft arms 15 pivot about a rockshaft 14 in response to operation of a hydraulic cylinder 16. A rockshaft control 17 is typically provided at the rearward end of the tractor for selectively controlling operation of the cylinder. As shown in FIGS. 2 and 3, the rockshaft arrangement can be used to lift the bottom hitch members between a lowered position (FIG. 2) about the stationary pivot axis on the tractor framework and a raised position (FIG. 3) depending upon the extent of contraction or extension of the cylinder 16.

The rockshaft arrangement, and three point hitch members as well as the lifting links 24 are provided as standard items on most modern estate and farm tractors. The lifting force provided through the rock shaft and hydraulic cylinder arrangement is usually substantial enough to lift and lower relatively heavy implements from the ground surface. It can also be utilized for wood splitting operations through provision of the present invention.

The present wood splitting attachment is provided to mount directly to the three point hitch arrangement for the tractor and is powered through the rockshaft and its associated control mechanisms to effectively split logs.

The present wood splitting attachment is comprised basically of only two relatively movable elements. A top hitch connector member 28 and the elements associated therewith are mounted to the top hitch member 12. A cross connector member 34 and associated elements are connected between the outward ends of the bottom hitch members 13 and are therefore movable relative to the top connector member 28. A blade 31 is provided on one of the members 28 or 34 and a wood support surface 37 is provided on the opposite member in alignment with the blade. During operation, surface 37 is moved selectively toward the blade as the rockshaft arrangement is controlled to lift the cross connector member upwardly. Wood placed between the blade and surface is forced against the blade.

The top hitch connector member 28 is preferably comprised of an elongated bar and brace 29 having an apertured swivel ball joint 30 at an inward end thereof for receiving a mounting pin 30*a*. The pin 30*a* will extend through the appropriate apertures of the top hitch member 12 and the ball joint aperture to pivotably mount the top hitch member to the tractor. The ball joint will allow slight lateral deflections along the two connector members.

An inner end of the top hitch connector member 28 mounts the splitting blade 31. It is preferred that the blade be connected to the top hitch connector 28 but it is well understood that it could also be mounted on the cross connector member with the wood support surface 37 then being provided on the top connector member 28.

The blade 31 includes a cutting edge 32 that preferably faces the cross member 34. The edge 32 is defined by converging sides of the blade that may be beveled according to the type of wood being split, power capacity of the tractor, and operator preference. It is preferred, however, that the blade sides initially include a gradual bevel angle adjacent the cutting edge, increasing progressively with the distance from the cutting edge. The blade edge is therefore easily imbedded within the wood and the splitting forces will increase as the blade is forced deeper into the wood.

The cross connector member 34 is preferably formed from a rigid elongated channel 35 having outwardly projecting pins 36 at opposite ends thereof. The pins are preferably coaxial to be received within the ends of the lower or bottom hitch members 13. The length of the cross connector member 34 is dependent upon the distance between the bottom hitch members 13. The wood support surface 37 is situated between the opposed ends of channel 35 and is identifiable by an upwardly projecting knuckle 38. The knuckle 38 (which may be a bolt head or other appropriate projection) is utilized to hold successive logs in place relative to the blade 31. As the blade comes into contact with the wood, the opposite end of the log is pressed into the knuckle and lateral movement is inhibited.

Figure 5:
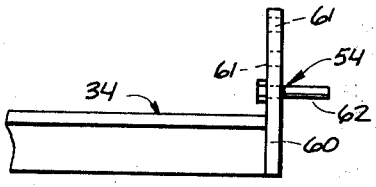
FIG. 5 is a fragmentary view of an alternate form of cross connector member and adjusting means of the present invention.
Figure 4:
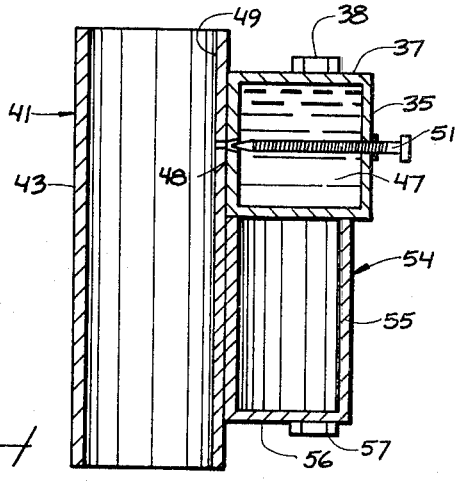
FIG. 4 is a sectional view taken along line 4—4 in FIG. 1.

The channel 35 as indicated in FIG. 4 is rectangular in cross section. This configuration is preferred. However, it is possible and effective to also utilize an "angle iron" (FIG. 5) form of cross connector member in lighter applications.

The wood support surface 37 is guided elevationally relative to the blade 31 by a guide means generally shown at 41. The guide means is provided to maintain elevational alignment of the support surface and the blade. It also movably interconnects the top hitch connector member and the cross connector member for controlling pivotal movement of the top hitch connector member 28 (and blade 31) and similar pivotal movement of cross connector member 34. The guide means 41 includes a rigid rod 42 and a tubular collar 43. Collar 43 is slidably received along the length of the rod. It is preferred that the rod 42 be rigidly secured to the top hitch connector member 28 and that the tubular collar 43 be fastened to the cross connector member 34 adjacent the wood support surface 37. However, it is feasible that the mounting arrangements for the rod and tubular collar be reversed, with the tubular collar being affixed to the top hitch connector member 28 and the rod 42 affixed to the cross connector member 34.

It is preferred that the blade edge 32 lie within a plane that is centered along the rigid rod 42 to thereby eliminate lateral forces between the blade and rod upon forceable engagement of the blade with an upwardly moving log. Thus centered, the forces applied will remain substantially vertical along the axis of the rod.

It is desirable to provide some form of lubrication means between the rod 42 and tubular collar 43 to prevent excessive wear. Such means is provided, in the preferred form of my invention, as a closed reservoir 47 (FIG. 4) within the channel 35.

Figure 1:
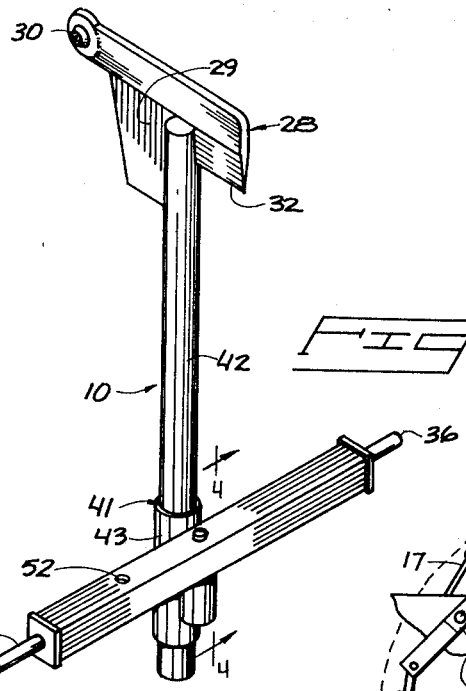
FIG. 1 is a pictorial view of the present splitting mechanism.

A filler plug 52 is indicated in FIG. 1 spaced along the channel 35 from the wood support surface to facilitate filling of the reservoir with a lubricant.

A lubricant bleed passage 48 is formed between the channel 35 and an inner surface 49 of the collar 43. The passage will allow flow of a lubricant from the reservoir into the collar and against the rod 42. Bleed control means is provided for regulating the flow rate of lubricant to the collar interior. This is accomplished by a needle shaft 51 threadably engaged through an aperture in the channel 35 and in alignment with the bleed passage 48. A pointed end of the shaft 51 can be selectively positioned to increase or decrease the size of the passage opening and therefore control flow rate through the passage.

As an alternative, a simple grease fitting (not shown) may be mounted to the tubular collar 43 to communicate openly through the collar to the interior surface 49. Periodic application of grease by a conventional form of grease gun can therefore be accomplished. Such arrangements can be made where the cross connector member 34 is formed of angle iron or bar stock rather than the channel 35.

An adjustment means is provided with the present invention to enable selective adjustment of the distance between the edge 32 and wood support surface to allow logs of different size to be split. The adjustment means 54 preferably comprises a riser 55 extending downwardly from the cross connector member 34 directly below the wood support surface 37 on the opposite cross connector member side. The riser 55 includes a secondary wood support surface 56 with a secondary knuckle 57, all of which is in direct alignment with the blade 31 and centered between ends of the cross connector member. To split shorter lengths of wood, the operator merely inverts the cross connector member (by rotating it end for end) therefore bringing the riser 55 to the upper side of the cross connector member with the primary wood support surface 37 facing downwardly.

An alternate form of adjustment means 54 may be made simply by providing brackets 60 (FIG. 5) at the outward end of the cross connector member 34 with apertures 61 for selectively receiving mounting pins 62 at different elevations relative to the cross member. Removable pins 62 will selectively fit any one of the mounting apertures 61.

Prior to operation, the present splitting attachment is mounted to the three point hitch members of a tractor firstly by mounting the top hitch connector member 28 to the top hitch member 12. The cross connector member can then be attached to the bottom hitch members 13 after the rod 42 has been slidably positioned within the collar 43. Care is taken in mounting the cross connector member to the bottom hitch members 13, that the correct distance is allowed for between the blade edge and wood support surface.

During operation, a log (shown in dashed lines in FIGS. 2 and 3) is positioned by hand against the wood support surface 37. The rockshaft control 17 is then operated to cause the bottom connector members to lift the cross connector member 34 and the log upwardly to engage the blade 31. Continued upward progression of the cross connector member and wood, causes blade penetration and subsequent splitting of the wood. Once the wood has split, the operator may move the rockshaft control to allow the wood support to drop back down to the open, inoperative position from the blade.

Having thus described our invention, what we claim is:

1. A wood splitting attachment for a tractor having three point hitch members with two bottom hitch members being powered to pivot toward and away from a remaining top hitch member, the attachment comprising:

a cross hitch connector member adapted to pivotally interconnect the two bottom hitch members for pivotal movement therewith;

a top hitch connector member adapted to be pivotably mounted to the top hitch member;

blade means on one of the hitch connector members, having a cutting edge facing the remaining hitch connector member;

a wood support surface on the remaining hitch connector member facing the blade means with the blade means and wood support surface arranged in a prescribed angular relationship and adapted to rigidly engage and brace a piece of wood; and guide means slidably interconnecting the top hitch connector member and the cross hitch connector member for holding the blade means and wood support surface in the prescribed angular relationship while controlling relative sliding movement of the hitch connector members toward and away from one another in a straight path in direct response to pivotal movement of the bottom hitch members toward and away from the top hitch member.

2. The wood splitting attachment as defined by claim 1 further comprising lubrication means along the guide means for receiving and directing flow of a lubricant to the guide means.

3. The wood splitting attachment as defined by claim 1 further comprising adjustment means on one of the connector members for selectively varying the effective distance between the wood support surface and the blade means.

4. The wood splitting attachment as defined by claim 1 wherein blade means is on the top hitch connector member and wherein the wood support is on the cross connector member in vertical alignment with the blade means.

5. The wood splitting attachment as defined by claim 1 further comprising a wood engaging knuckle on the wood support surface for engaging and securing a piece of wood in place between the support surface and blade means as they are moved relative to one another.

6. The wood splitting attachment as defined by claim 1 wherein the guide means is comprised of a tubular collar affixed to one of the connector members and a rigid rod slidably received within the tubular collar and affixed to the remaining connector member.

7. The wood splitting attachment as defined by claim 6 wherein the tubular collar is affixed to the cross connector member and wherein the rigid rod is affixed to the top hitch connector member.

8. The wood slitting attachment as defined by claim 6 further comprising lubrication means along the guide means for receiving and delivering a lubricant between the tubular collar and the rigid rod.

9. The wood splitting attachment as defined by claim 6 wherein the blade means is affixed to the top hitch connector member adjacent to and projecting outwardly of the guide means.

10. The wood splitting attachment as defined by claim 6 wherein the cutting edge of the blade means lies along a plane that is centered on the longitudinal axis of the tubular collar.

11. The wood splitting attachment as defined by claim 6 wherein the tubular collar is affixed to the cross connector member and further comprising lubrication means on the cross connector member having a lubricant reservoir and a lubricant bleed passage extending from open communication with the reservoir to an inner surface of the tubular collar for delivering lubricant from the reservoir to the area between the collar and rigid rod.

12. The wood splitting attachment as defined by claim 11 further comprising bleed control means in the bleed passage for selectively controlling flow of lubricant to the collar and rod.

* * * * *